US009493334B2

(12) United States Patent
Graus et al.

(10) Patent No.: US 9,493,334 B2
(45) Date of Patent: Nov. 15, 2016

(54) CONTAINER HAVING DEVICE FOR PREVENTING FOAMING AND METHOD FOR PRODUCING THE DEVICE

(71) Applicant: Sartorius Stedim Biotech GmbH, Goettingen (DE)

(72) Inventors: Andreas Graus, Noerten-Hardenberg (DE); Michael Gohs, Goettingen (DE); Holger Linne, Goettingen (DE); Michael Schuetzler, Rosdorf (DE)

(73) Assignee: Sartorius Stedim Biotech GmbH (DE)

( * ) Notice: Subject to any disclaimer, the term of this patent is extended or adjusted under 35 U.S.C. 154(b) by 0 days.

(21) Appl. No.: 14/435,531

(22) PCT Filed: Sep. 20, 2013

(86) PCT No.: PCT/EP2013/002841

§ 371 (c)(1),
(2) Date: Apr. 14, 2015

(87) PCT Pub. No.: WO2014/072010

PCT Pub. Date: May 15, 2014

(65) Prior Publication Data

US 2015/0274503 A1 Oct. 1, 2015

(30) Foreign Application Priority Data

Nov. 12, 2012 (DE) ..... 10 2012 022 017

(51) Int. Cl.
*B67D 1/12* (2006.01)
*B65B 3/22* (2006.01)

(52) U.S. Cl.
CPC ..... *B67D 1/1272* (2013.01); *B65B 3/22* (2013.01)

(58) Field of Classification Search
CPC ..... B65B 3/22; B67D 1/1272
See application file for complete search history.

(56) References Cited

U.S. PATENT DOCUMENTS 969,997 A 9/1910 Thiem
2,946,345 A * 7/1960 Weltmer ..... F16K 17/42 137/590
3,321,140 A * 5/1967 Parkison ..... E03C 1/086 239/428.5

(Continued)

FOREIGN PATENT DOCUMENTS

EP 0 213 783 3/1987
EP 2 294 001 11/2011

(Continued)

OTHER PUBLICATIONS

Translation International Preliminary Report on Patentability and Written Opinion.
International Search Report of Nov. 26, 2013.

*Primary Examiner* — Frederick C Nicolas
*Assistant Examiner* — Bob Zadeh
(74) *Attorney, Agent, or Firm* — Gerald E. Hespos; Michael J. Porco; Matthew T. Hespos

(57) ABSTRACT

A container has an outflow arranged in the vicinity of the bottom and a vortex breaker mounted upstream from the outflow for preventing foaming. The vortex breaker has a vertical main wall and two vertical side wings oriented away from one another to define a T-shape. The main wall merges into a fixing arm. A method also is provided for producing the vortex breaker. The method includes a) cutting a flat plate to define a main wall, two side wings, and a fixing arm connected to the main wall; and b) folding out the side wings in opposing directions in each case into a final position arranged transverse to the main wall. The vortex breaker is applicable in chemistry, biotechnology, and filtration technology.

7 Claims, 4 Drawing Sheets

(56) References Cited

U.S. PATENT DOCUMENTS

| | | | | |
|---|---|---|---|---|
| 5,096,578 | A * | 3/1992 | Strickland | B01D 19/0042 210/188 |
| 5,790,619 | A * | 8/1998 | Peck | G21C 19/28 138/39 |
| 5,887,789 | A * | 3/1999 | Szabo | B65B 3/22 239/1 |
| 6,014,987 | A * | 1/2000 | List | B64D 37/08 137/549 |
| 2010/0012666 | A1* | 1/2010 | Morrissey | C12M 23/26 220/601 |
| 2012/0080112 | A1* | 4/2012 | Van Haaren | E03B 11/04 138/39 |
| 2015/0274503 | A1* | 10/2015 | Graus | B67D 1/1272 222/1 |

FOREIGN PATENT DOCUMENTS

| | | | |
|---|---|---|---|
| GB | 239 350 | | 9/1925 |
| JP | 07-187282 | | 7/1995 |
| JP | 07187282 | A * | 7/1995 |
| JP | 2004-182275 | | 7/2004 |
| WO | 2009/145874 | | 12/2009 |

* cited by examiner

CONTAINER HAVING DEVICE FOR PREVENTING FOAMING AND METHOD FOR PRODUCING THE DEVICE

BACKGROUND

1. Field of the Invention

The invention relates to a container having an outflow arranged in the vicinity of the bottom and a device for preventing foaming, which is implemented as a vortex breaker mounted upstream of the outflow.

2. Description of the Related Art

Furthermore, the invention relates to a device for preventing foaming, which is implemented as a vortex breaker which can be mounted upstream from an outflow of a container.

Furthermore, the invention relates to a method for producing a device for preventing foaming, which is implemented as a vortex breaker, wherein the vortex breaker can be mounted upstream from an outflow of a container and can be connected to the outflow.

The invention is applicable in particular in chemistry, biotechnology, and filtration technology.

During the recirculation of the concentrate in cross-flow filtration facilities in the recirculation containers, the product can foam up strongly, in particular in the case of protein-containing media, in conjunction with air. The filtration is impaired in this case by the introduction of air. Concentrating to a minimal recirculation volume is only possible with difficulty in practice in this case.

In particular with a low fill level of the recirculation container, a vortex (eddy) can arise in this case and a relatively large amount of air can be drawn into the medium.

A container having a vortex breaker is known from EP 2 294 001 B1. Undesired foaming is also to be prevented here.

For this purpose, a circular vortex breaker, for example, is arranged at a distance, which is spaced apart by a plurality of arms, to an outflow arranged on the bottom of a container.

The known device has the disadvantage, on the one hand, that it cannot optimally prevent eddies occurring in parallel to the bottom and, on the other hand, it can only be mounted later upstream of an outflow opening arranged in a container with difficulty.

The object of the present invention is therefore to further optimize undesired foaming occurring due to eddies in a container having an outflow arranged in the vicinity of the bottom and to enable a later installation of a device for preventing foaming in a container.

A further object of the invention is to specify a corresponding device and a method for the production thereof.

A vortex breaker is implemented as a vertical or nearly vertical wall arrangement (referred to as vertical wall arrangement hereafter), that is fastened in the outflow via a fixing arm protruding into the outflow.

The vertical wall arrangement reduces eddies transverse to the container bottom and foaming is optimally prevented. Due to only one fixing arm, that protrudes into the outflow, the device for preventing foaming can be introduced easily and in particular also later into a container and fastened on the outflow.

The outflow may be arranged laterally above the bottom, wherein the fixing arm has a vertical main wall on its end facing away from the outflow and wherein the vertical main flow has two vertical side wings, which are oriented away from one another, on its end facing away from the outflow. Due to the vertical side wings, the vortex breaker consists of a vertical wall arrangement, which is implemented similarly to a T-shape and results in a particularly low-foam result. In this case, the angles between the main wall and the side wings can be different and can deviate from 90°, for example, up to 45° and up to 135° (referred to as T-shaped hereafter).

One of the side wings may have a breakout toward the bottom. The breakout, which forms a type of window, contributes to complete or at least substantially complete emptying of the container.

The container may be a recirculation container of a cross-flow filtration facility.

The vertical main wall, in a T-shaped implementation, has two vertical side wings oriented away from one another, and the main wall merges into a fixing arm, which is fastenable with its free end in the outflow of the container.

The device has the above-described advantages and is easily fastenable in the outflow of the container in particular with the free end of the fixing arm.

According to a further embodiment of the invention, to arrange the fixing arm in a lateral outflow of the container, the fixing arm is oriented away in the horizontal direction at the end of the main wall facing away from the side wings, and has a catch lug, which can latch in corresponding formations of the outflow, in each case on opposing sides in the vertical direction. For mounting, the fixing arm is simply plugged into the outflow so that it latches. The fixing arm can fundamentally also be glued or also welded to the outflow.

The catch lugs may be formed by an arrowhead-shaped implementation of the free end of the fixing arm. Due to the arrowhead-shaped implementation of the free end, the fixing arm may be inserted particularly easily into the outflow.

The fixing arm may have a stepped stop on its end facing toward the main wall. The stepped stop contributes to the correct latching position.

A method also is provided and comprises the following steps:

a) cutting the vortex breaker, having a main wall, two side wings, and a fixing arm connected to the main wall, out of a flat plate and
b) folding out the side wings in opposing directions in each case into a final position arranged transversely to the main wall.

Due to the implementation of the vortex breaker from a flat plate, a spatially implemented vortex breaker results, which is nonetheless implemented in one piece and is easy to produce. The vortex breaker can obtain its three-dimensional contour in this case by hot forming or cold forming. Fundamentally, the vortex breaker can also be implemented from multiple parts, which are welded or glued to one another. It is also fundamentally possible to produce the vortex breaker by way of an injection molding method.

The vortex breaker through a container opening into the container interior and is plugged with one free end of the fixing arm into the outflow opening of the outflow and latched. In this case, the vortex breaker can be plugged into the outflow using a long-handled gripping tool in particular.

Further details of the invention result from the following description in detail and the appended drawings, in which preferred embodiments of the invention are illustrated as examples.

DETAILED DESCRIPTION OF THE PREFERRED EMBODIMENTS

Figure 1:
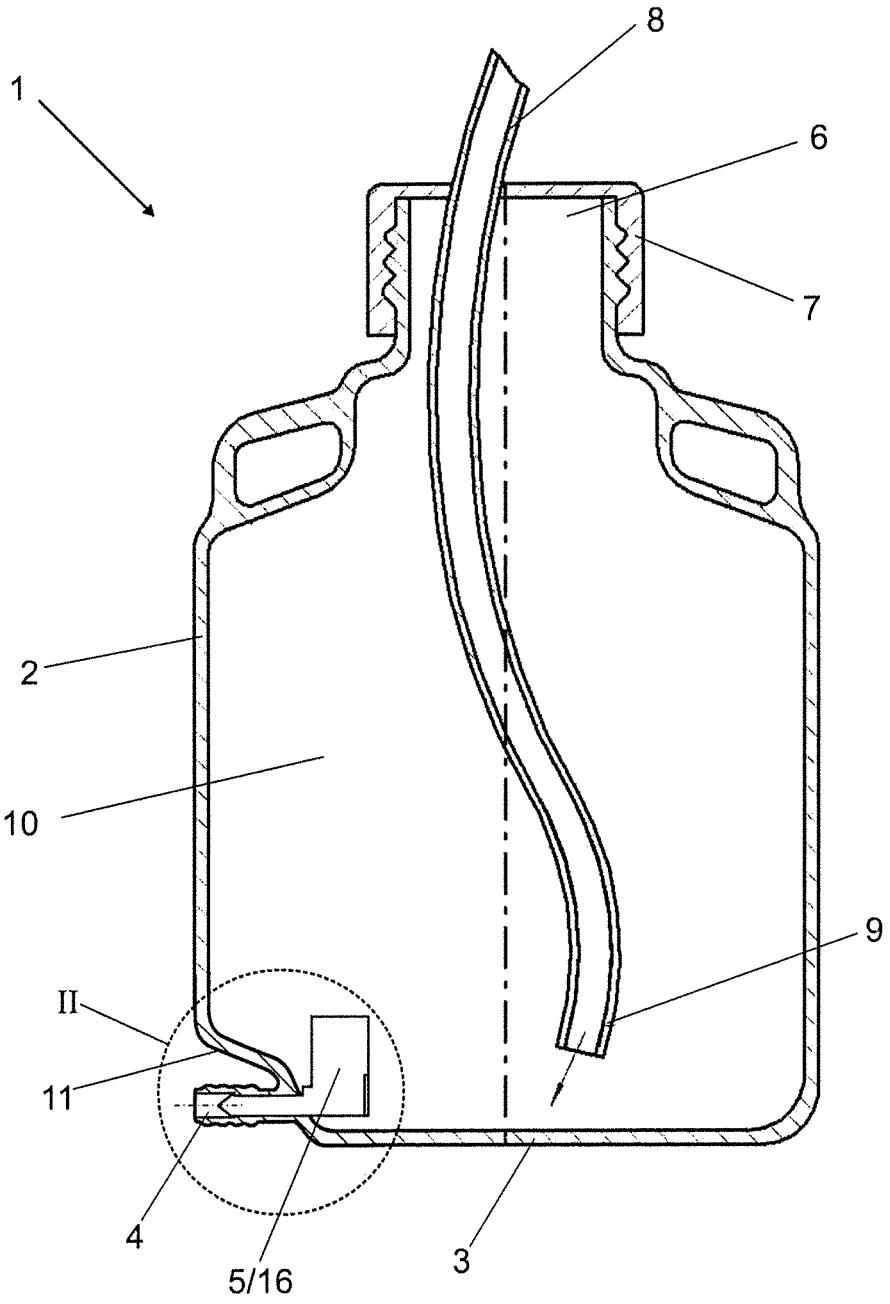
FIG. 1 shows a side view in section of a container having a device for preventing foaming.
Figure 2:
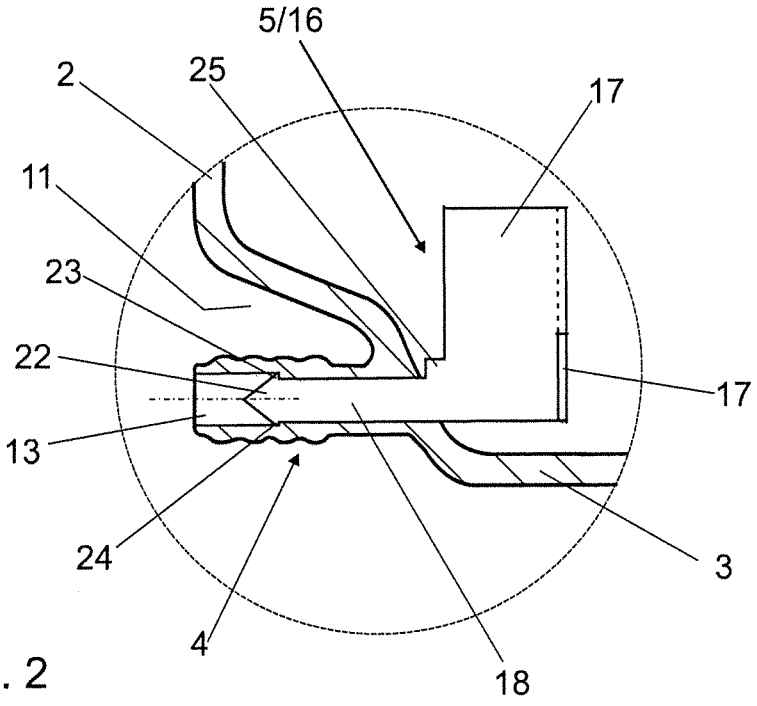
FIG. 2 shows a side view in section of detail II from FIG. 1 in an enlarged illustration.
Figure 3:
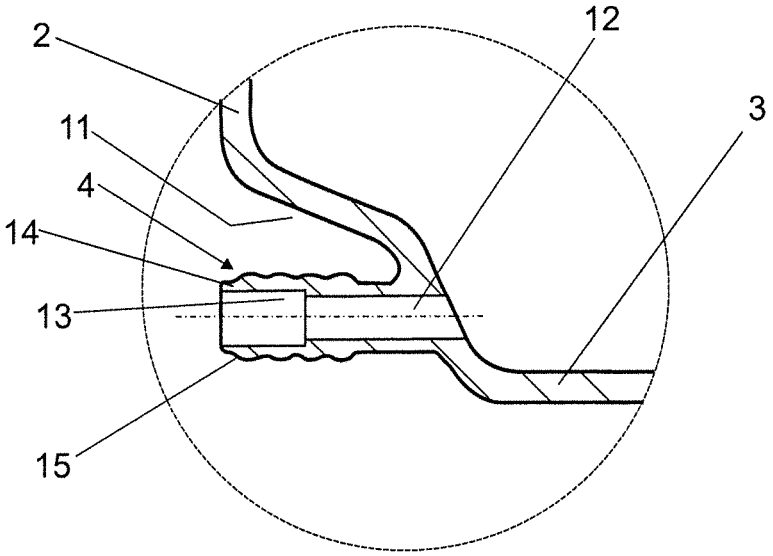
FIG. 3 shows the detail from FIG. 2 without device for preventing foaming.
Figure 4:
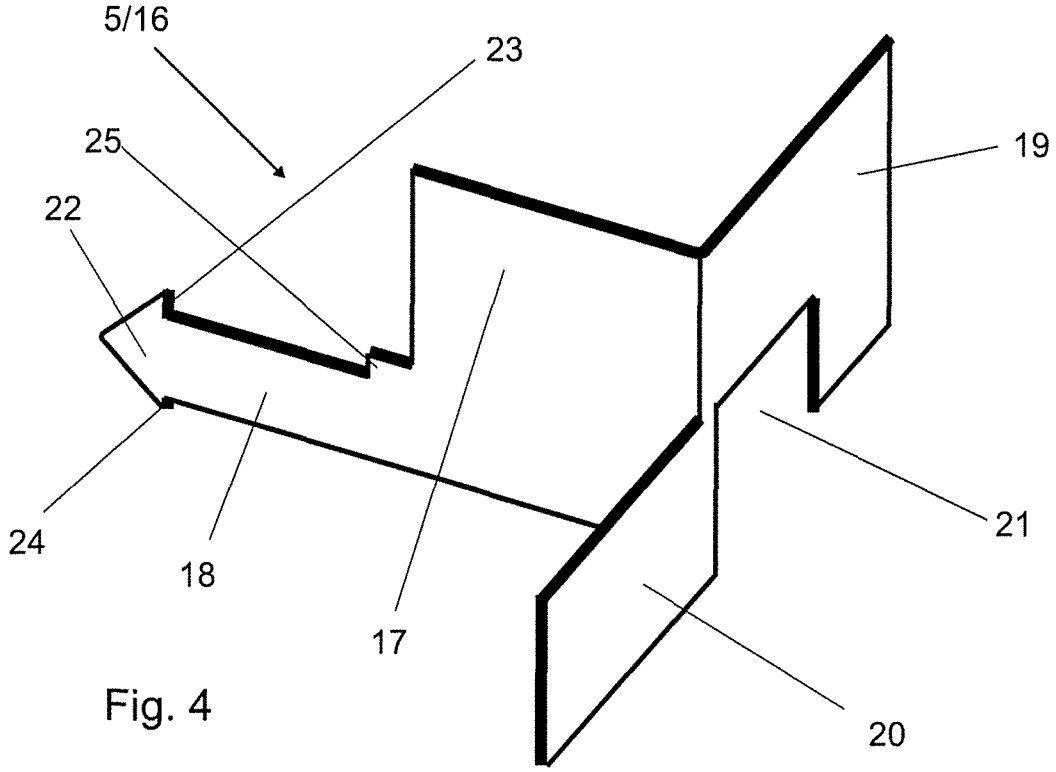
FIG. 4 shows a spatially enlarged illustration of a device for preventing foaming, which is implemented as a vortex breaker.
Figure 5:
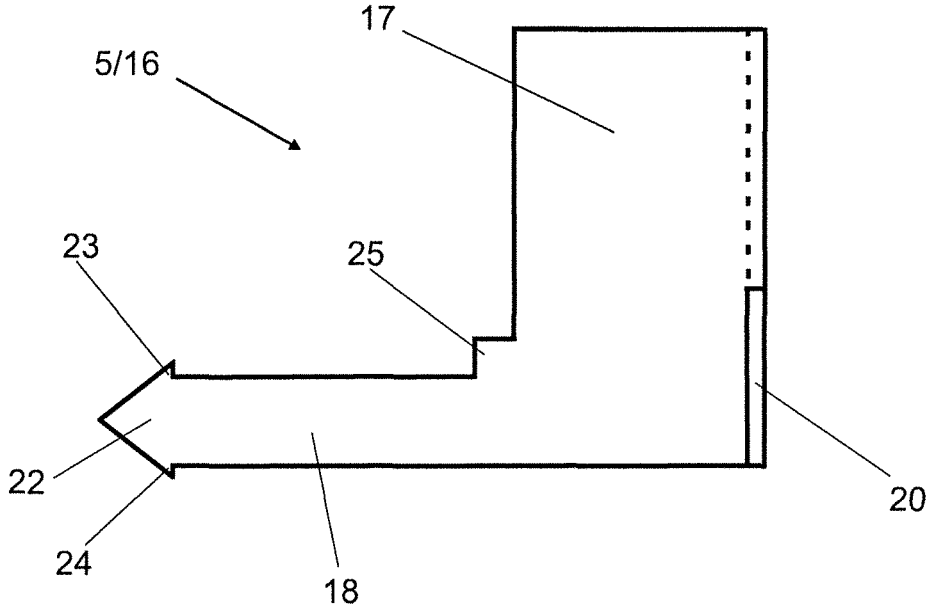
FIG. 5 shows a side view in an enlarged illustration of the vortex breaker from FIG. 1.

A container 1 essentially consists of a container wall 2 having bottom 3, an outflow 4, and a device 5 for preventing foaming.

The lateral container wall 2 merges downward in the vertical direction into an approximately horizontal bottom 3. A container opening 6, which is closed by a screw-on cover 7, is located in the vertical direction upward. An intake hose 8, which forms an inflow into the container interior 10 with its free end 9, is guided through the screw-on cover 7.

A beveled, inwardly curved formation 11, which encloses the horizontal outflow 4 in the vertical direction upward at a distance, is located in the transition between bottom 3 and container wall 2. The outflow 4 has an internal borehole 12, which merges toward the free end of the outflow 4 into a setback 13. At its free end, the outflow 4 is implemented as a hose fitting 15, for example, a hose adapter.

The device 5 for preventing foaming is implemented as a vortex breaker (eddy breaker) 16. The vortex breaker 16 has a fixing arm 18 connected to a vertical main wall 17. The vertical main wall 17 has, on its end facing away from the fixing arm 18, a first vertical side wing 19 and a second vertical side wing 20. The two side wings 19, 20 are oriented away from one another and each form a right angle with the main wall 17 in the exemplary embodiment. The first side wing 19 has a downwardly open breakout 21. In the exemplary embodiment of FIG. 6, the breakout 21 corresponds to the size of the second side wing 20.

The fixing arm 18 is adapted in its dimensions to the corresponding outflow 4, i.e., to the internal borehole 12 and the setback 13. At its free end 22, the fixing arm is implemented as arrowhead-shaped in the exemplary embodiments, wherein two catch lugs 23, 24 located opposite to one another are formed. The fixing arm has a stepped stop 25 on its end facing toward the main wall 17.

Figure 6:
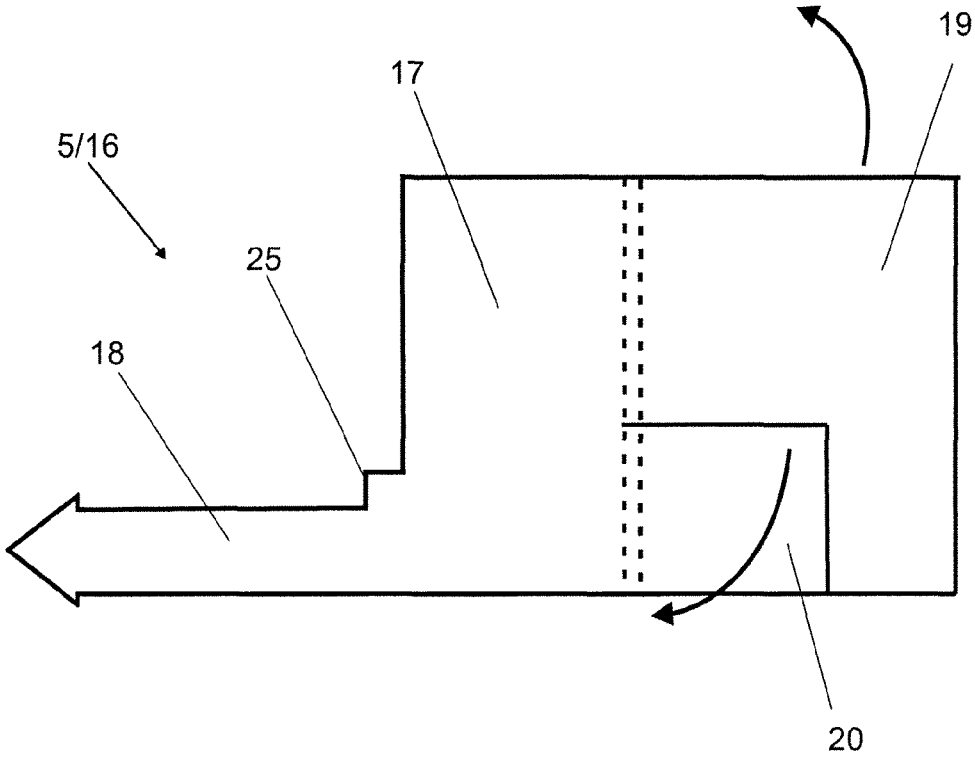
FIG. 6 shows a side view of the vortex breaker from FIG. 5 in a developed view.

The vortex breaker 16 can be cut out of a flat plate having its developed view illustrated in FIG. 6. That is to say, the vortex breaker 16 having its main wall 17, its side wings 19, 20, and its fixing arm 18 is cut out of a flat plate. In a following step, the first vertical side wing 19 is then folded out of the plane to the rear and the second vertical side wing 20 is folded out of the plane to the front. The folding out can be performed by hot forming or cold forming.

For installation in the container 1, the vortex breaker 16 is introduced through the container opening 6 into the container interior 10 and is plugged with the free end 22 of the fixing arm 18 into the internal borehole 12 of the outflow 4 until the catch lugs 23, 24 latch in the setback 13 of the outflow 4.

Figure 7:
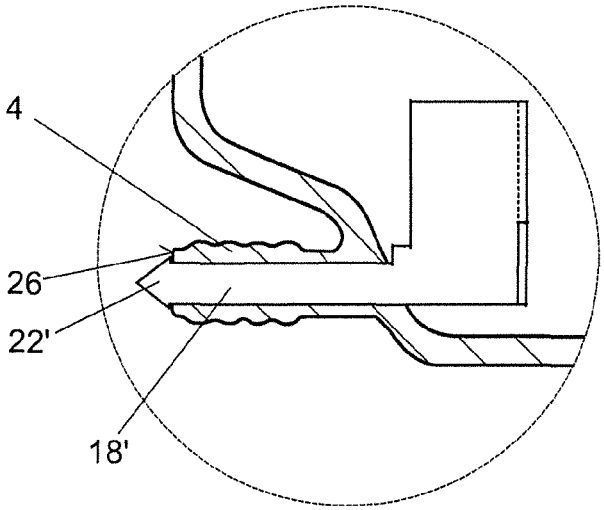
FIG. 7 shows a side view, partially in section, of a further vortex breaker in an illustration corresponding to detail II from FIG. 1.

According to the exemplary embodiment of FIG. 7, the fixing arm 18' can protrude with its free end 22' out of the outflow 4 and can latch on the external end face 26.

Of course, the embodiments discussed in the special description and shown in the figures only represent illustrated exemplary embodiments of the present invention. A broad spectrum of possible variations is apparent to a person skilled in the art in view of the present disclosure.

LIST OF REFERENCE SIGNS

1 container
2 container wall
3 bottom
4 outflow
5 device
6 container opening
7 screw-on cover
8 inlet hose
9 free end of 8
10 container interior
11 formation
12 internal borehole of 4
13 setback of 4
14 free end of 4
15 hose fitting
16 vortex breaker
17 vertical main wall of 16
18, 18' fixing arm of 16
19 first vertical side wing of 16
20 second vertical side wing of 16
21 breakout of 19
22, 22' free end of 18
23 upper catch lug of 22
24 lower catch lug of 22
25 stop of 18
26 end face of 4

The invention claimed is:

1. A container (1) comprising:

an outflow (4) arranged in a vicinity of a bottom (3) of the container and laterally above the bottom (3); and a vortex breaker (16) mounted upstream of the outflow (4) for preventing foaming, the vortex breaker (16) including a vertical wall fastened in the outflow (4) via a fixing arm (18, 18') protruding into the outflow (4), the fixing arm (18, 18') having a vertical main wall (17) on an end of the fixing arm (18, 18') facing away from the outflow (4), and the vertical main wall (17) having two vertical side wings (19, 20) oriented away from one another on an end of the vertical main wall (17) facing away from the outflow (4).

2. The container of claim 1, wherein at least one of the two vertical side wings (19, 20) has a breakout (21) toward the bottom (3).

3. The container of claim 1, wherein the container (1) is a recirculation container of a cross-flow filtration facility.

4. A device (5) for preventing foaming, comprising:

a vortex breaker (16) that can be mounted upstream of an outflow (4) of a container (1), the vortex breaker (16) having a vertical main wall (17), and two vertical side wings (19, 20) oriented away from one another in a T-shaped implementation, and the vertical main wall (17) merges into a fixing arm (18, 18') that has a free end dimensioned and configured to be fastened in the outflow (4) of the container (1), the fixing arm (18, 18') being oriented away from the vertical main wall (17) in a horizontal direction at an end of the vertical main wall (17) facing away from the two vertical side wings (19, 20) and having catch lugs (23, 24) on sides opposite to one another in a vertical direction, the catch lugs (23, 24) being dimensioned and configured to be latched in corresponding formations of the outflow (4).

5. The device of claim 4, wherein the catch lugs (23, 24) are formed by an arrowhead-shaped implementation of the free end (22, 22') of the fixing arm (18, 18').

6. The device of claim 4, wherein the fixing arm (18, 18') has a stepped stop (25) on the free end (22, 22') of the fixing arm (18, 18') facing toward the vertical main wall (17).

7. A method for producing a vortex breaker (16) for preventing foaming, the vortex breaker (16) being configured to be mounted upstream from an outflow (4) of a container (1) and to be connected to the container (4), the method comprising:

a) cutting a flat plate to form a main wall (17), two side wings (19, 20), and a fixing arm (18, 18') connected to the main wall (17); and b) folding out the two side wings (19, 20) in opposite directions in each case into a final position arranged transversely to the main wall (17);

c) introducing the vortex breaker (16) through an opening of the container (6) into an interior of the container (10);

d) plugging a free end (22, 22') of the fixing arm (18, 18') into an outflow opening of the outflow (4); and e) latching the fixing arm (18, 18') to the outflow (4).

* * * * *